US005954892A

United States Patent [19]

Musingo et al.

[11] Patent Number: 5,954,892

[45] Date of Patent: Sep. 21, 1999

[54] METHOD AND COMPOSITION FOR PRODUCING ZINC PHOSPHATE COATINGS ON METAL SURFACES

[75] Inventors: Edward M. Musingo, Quakertown; Charles R. Ike, Clarks Green, both of Pa.

[73] Assignee: Bulk Chemicals, Inc., Reading, Pa.

[21] Appl. No.: 09/033,563

[22] Filed: Mar. 2, 1998

[51] Int. Cl.[6] ..... C23C 22/07

[52] U.S. Cl. ..... 148/262; 148/247; 106/14.12; 106/287.19; 106/287.29

[58] Field of Search ..... 148/247, 262; 106/14.12, 287.19, 287.29

[56] References Cited

U.S. PATENT DOCUMENTS

| | | | |
|---|---|---|---|
| 4,114,505 | 9/1978 | Loeser et al. | 411/366 |
| 4,292,096 | 9/1981 | Murakami et al. | 204/486 |
| 4,311,535 | 1/1982 | Yasuhara et al. | 204/486 |
| 4,330,345 | 5/1982 | Miles et al. . | |
| 4,338,141 | 7/1982 | Senzaki et al. | 148/262 |
| 4,497,667 | 2/1985 | Vashi . | |
| 4,595,424 | 6/1986 | Hacias | 148/241 |
| 4,824,490 | 4/1989 | Oei et al. | 148/259 |
| 4,950,339 | 8/1990 | Gehmecker et al. | 148/262 |
| 4,961,794 | 10/1990 | Miyamoto et al. | 148/262 |
| 5,211,769 | 5/1993 | Sobata et al. | 148/260 |
| 5,236,565 | 8/1993 | Müller et al. | 204/486 |
| 5,261,973 | 11/1993 | Sienkowski et al. | 148/262 |
| 5,397,390 | 3/1995 | Gorecki | 106/287.11 |
| 5,531,820 | 7/1996 | Gorecki | 106/287.11 |
| 5,547,595 | 8/1996 | Hacias | 508/156 |
| 5,588,989 | 12/1996 | Vonk et al. | 106/14.12 |
| 5,603,754 | 2/1997 | Aoki et al. | 106/14.12 |
| 5,603,818 | 2/1997 | Brent et al. | 204/488 |
| 5,702,759 | 12/1997 | White et al. | 427/142 |

FOREIGN PATENT DOCUMENTS 2 080 835 2/1982 United Kingdom .

*Primary Examiner*—Ngoclan Mai
*Attorney, Agent, or Firm*—Ratner & Prestia

[57] ABSTRACT

A method and composition for forming a zinc phosphate coating on a metal surface utilizes an aqueous solution of zinc, phosphate, nitrate, nickel, a compound containing a group IV-B element, and a fluosurfactant. The method involves contacting the metal surface with such a bath under process conditions such that a coating is formed on the metal surface. Preferably, the compound containing a group IV-B element is a fluoacid of titanium, zirconium, or hafnium. More preferably, the fluoacid is fluotitanic acid. The fluosurfactant may be any compatible fluosurfactant but preferably is an amine perfluoroalkyl sulfonate or a non-ionic, fluorinated alkyl polyoxethylene ethanol or a combination of both. The coating serves to improve the ability of the metal to retain a lubricant on its surface (for cold working of the metal), to improve corrosion resistance, and to improve paint adhesion.

20 Claims, No Drawings

METHOD AND COMPOSITION FOR PRODUCING ZINC PHOSPHATE COATINGS ON METAL SURFACES

FIELD OF THE INVENTION

The present invention pertains to treating metal surfaces by depositing zinc phosphate coatings on the metal surfaces to prepare the metal surfaces for cold working, to improve the corrosion resistance of the metal, or to serve as a pretreatment to improve the adhesion of subsequently applied decorative coatings, such as paint.

BACKGROUND OF THE INVENTION

In the fabrication of metal objects, one of the known process steps is the cold working of metals. Cold working involves the physical deformation of a metal article (e.g., a blank, slug, or preform) at a temperature well below the recrystallization temperature of the metal, and preferably within about 200° F. of room temperature. Typical cold working processes include cold extrusion, cold heading, and wire and tube pulling deformation operations.

In order to deform a metal article, all cold working processes involve contacting the metal article with at least one die to work the metal article. When a metal is passed through a die during cold working, the friction between the metal being worked and the die causes the generation of heat. The heat caused by work hardening during deformation also increases the temperature of the die surface and the metal article. The generated heat, in turn, can have detrimental effects on both the dies and on the metal articles. For example, the die can wear rapidly due to the generated heat. Also, the heat can cause surface impurities on the surface of the metal article.

Accordingly, it is desirable to reduce the friction by applying a lubricant to the metal surface and/or the die in order to avoid or minimize the generation of heat during cold working. In order for a lubricant to remain in contact with the metal during one or more cold working drawings, a coating (i.e., a lubricant carrier) should first be adhered to the metal surface.

Numerous zinc phosphate coatings have been proposed in order to achieve this function as a lubricant carrier. It is well known to form metal phosphate coatings by the application of an aqueous acidic phosphatizing solution to metal surfaces. The surface of the metal reacts with the solution to form an integral layer of substantially insoluble crystalline phosphate on the surface of the metal. This crystalline layer increases the ability of the metal to retain a uniform film of lubricant over the entire surface. This lubricant reduces metal to metal contact in cold forming operations. In addition to serving as a lubricant carrier in preparation for cold working, some zinc phosphate coatings can improve corrosion resistance of the metal surface and improve the adhesion of paint to the metal surface.

For example, U.S. Pat. No. 5,588,989 to Vonk et al. discloses the use of an oxime accelerator in a zinc phosphate bath which may also contain fluoride ions, nitrate ions, and ions of various metals, such as nickel, cobalt, calcium, magnesium, manganese, and iron.

In addition, U.S. Pat. No. to 5,603,818 to Brent et al. is directed to a process for treating metal parts to provide rust-inhibiting coatings in at least five discrete steps. The first step in this process is the use of an aqueous phosphatizing solution that is used to deposit a phosphate coating on a metal surface. Various inorganic phosphate solutions are suggested, including zinc phosphate. Chlorate ions are disclosed as an additive to the phosphate solution.

Despite advances in both the composition of the phosphate coating solution and the phosphatizing process, there is a continued demand for still further improvements in the compositions and processes to provide more control over the process and to reduce the time needed to achieve a high quality coating of sufficient coating weight.

After cold working or other fabrication methods, it is desirable to deposit a coating or "pretreatment" on a metal surface in order to improve the adhesion of a subsequently applied decorative coating to the metal surface and to improve corrosion resistance. Before chromium was recognized as environmentally hazardous, compositions containing chromium were used as such pretreatments to improve the corrosion resistance and paint adhesion of metals. Chromium chromate and chromium phosphate were two compounds typically used as coatings for metal. Recent developments led to the use of chrome-free pretreatments, which typically include a polymeric resin and a fluo or oxy-fluo form of group IV-B elements of the periodic table (e.g., titanium, zirconium, and hafnium). These chrome-free pretreatments provide surface coatings whose compositions are based on the products of the interaction between the metallic substrate and the pretreatments.

It is a goal of the present invention to provide a method and composition which farther reduces friction during cold working, can be deposited in a shorter time, improves the corrosion resistance of the metal, and improves the paint adhesion of metal surfaces.

SUMMARY OF THE INVENTION

To achieve these and other objects, and in view of its purposes, the present invention provides a composition and method for forming a zinc phosphate coating on a metal surface. The composition is a bath comprising an aqueous solution of zinc, phosphate, nitrate, nickel, a compound containing a group IV-B element, and a fluosurfactant. The method involves contacting the metal surface with a composition of the present invention under process conditions such that a zinc phosphate coating is formed on the metal surface.

According to an embodiment of the present invention, the concentration of zinc is from about 1 to about 30 g/l; the concentration of phosphate (measured as $P_2O_5$) is from about 2 to about 60 g/l; the concentration of nitrate is from about 1 to about 35 g/l; the concentration of nickel is from about 0.002 to about 0.4 g/l; the concentration of the compound containing a group IV-B element (measured as the group IV-B element) is from about 0.001 to about 0.1 g/l; and the concentration of the fluosurfactant is from about 0.0001 to about 0.1 g/l. More preferably, the concentration of zinc is from about 5 to about 15 g/l; the concentration of phosphate (measured as $P_2O_5$) is from about 20 to about 40 g/l; the concentration of nitrate is from about 5 to about 20 g/l; the concentration of nickel is from about 0.05 to about 0.2 g/l; the concentration of the compound containing a group IV-B element (measured as the group IV-B element) is from about 0.004 to about 0.007 g/l; and the concentration of the fluosurfactant is from about 0.005 to about 0.02 g/l.

According to another embodiment of the present invention, the bath also includes chlorate ions. Preferably, the concentration of the chlorate ions is from about 0.02 to about 0.7 g/l. More preferably, the concentration of the chlorate ions is from about 0.07 to about 0.1 g/l.

According to another embodiment of the present invention, the compound containing a group IV-B element is selected from the group consisting of a fluoacid of at least one of titanium, zirconium, and hafnium. More preferably, the fluoacid is fluotitanic acid.

According to another embodiment of the present invention, the fluosurfactant is a fluorocarbon selected from the group consisting of an amine perfluoroalkyl sulfonate and a non-ionic, fluorinated alkyl polyoxethylene ethanol.

It is to be understood that both the foregoing general description and the following detailed description are exemplary, but are not restrictive, of the invention.

DETAILED DESCRIPTION OF THE INVENTION

The method and composition of the present invention utilize a bath for depositing a zinc phosphate coating on a metal surface in order to serve as a lubricant carrier in preparing metal surfaces for cold working, to improve the corrosion resistance of the metal, and to serve as a pretreatment to improve the adhesion of subsequently applied decorative coatings, such as paint. The present invention may be used on a wide variety of metals, including, but not limited to, steel (such as galvanized steel and cold rolled steel), steel alloys, aluminum and aluminum alloys, zinc and zinc alloys, iron and iron alloys, and combinations thereof. As a lubricant carrier for preparing the metal surfaces for cold working, the method and composition of the present invention are preferably used to treat steel and steel alloys, zinc and zinc alloys, iron and iron alloys, and combinations thereof.

The composition of the present invention is a bath comprising an aqueous, acidic solution of zinc, phosphate, nitrate, nickel, a compound containing a group IV-B element, and a fluosurfactant. The concentrations of the various constituents may vary over a wide range depending on a number of process conditions as discussed below. Depending on the process conditions, however, the concentrations of the constituents may vary over the following ranges: from about 1 to about 30 g/l zinc; from about 2 to about 60 g/l phosphate (measured as $P_2O_5$); from about 1 to about 35 g/l nitrate; from about 0.002 to about 0.4 g/l nickel; from about 0.001 to about 0.1 g/l of the compound containing a group IV-B element (measured as the group IV-B element); and from about 0.0001 to about 0.1 g/l of the fluosurfactant. More preferably, the concentration of zinc is from about 5 to about 15 g/l; the concentration of phosphate (measured as $P_2O_5$) is from about 20 to about 40 g/l; the concentration of nitrate is from about 5 to about 20 g/l; the concentration of nickel is from about 0.05 to about 0.2 g/l; the concentration of the compound containing a group IV-B element (measured as the group IV-B element) is from about 0.004 to about 0.007 g/l; and the concentration of the fluosurfactant is from about 0.005 to about 0.02 g/l.

The composition of the present invention should be acidic, typically having a pH of less than about 5 and preferably between about 1 and 3. In zinc phosphate baths, it is typical to use the ratio of total acid to free acid as the measure of acidity. Depending on the application and other process conditions, it is generally preferable to keep the ratio of total acid to free acid between about 4:1 to about 25:1 and preferably between about 5:1 and about 9:1. This ratio can be adjusted in known ways, such as by the addition of phosphoric acid, nitric acid, phophate salts, nitrate salts, zinc salts, sodium hydroxide, zinc oxide, potassium hydroxide, sodium carbonate, zinc carbonate, or potassium carbonate.

The components of the zinc phosphate baths of the present invention can either be added individually or premixed in any combination and may be dissolved in water either before or after addition. It is not believed that the order of addition is important in preparing the zinc phosphate baths of the present invention. The components may be added in any known forms. For example, zinc may be added in the form of zinc oxide; phosphate may be added as phosphoric acid; nickel and nitrate may be added as nitric acid and nickel nitrate; the compound of the group IV-B element may be added as an acid or salt of a group IV-B fluoride; and the fluosurfactant may be added as an aqueous solution.

Preferably, the compound containing a group IV-B element contains fluoride. More preferably, the compound is a fluoacid of at least one of titanium, zirconium, and hafnium, or combinations thereof. Most preferably, the fluoacid is fluotitanic acid.

The fluosurfactant selected may be any compatible fluorocarbon which reduces the surface tension of the bath. Preferably, the fluorocarbon is at least one of an amine perfluoroalkyl sulfonate or a non-ionic, fluorinated alkyl polyoxethylene ethanol. In particular, an amine perfluoroalkyl sulfonate sold under the trademark FLUORAD® FC-99 and a non-ionic, fluorinated alkyl polyoxethylene ethanol sold under the trademark FLUORAD® FC-170C, both by 3M of St. Paul, Minn., are especially suitable. Of the two, the fluosurfactant sold under the trademark FLUORAD® FC-99 appears to be more preferable for most applications. Even more preferably, the use of these two fluosurfactants in combination provides particularly good results. It is noteworthy that the fluosurfactant, even in small amounts, results in a dramatic effect on the quality of the coating and on the needed contact time.

Other additives known to be added in zinc phosphate baths may also be utilized. For example, the bath might also include chlorate ions, which may be added as sodium chlorate. Chlorate ions are known to oxidize ferrous ions. Preferably, the concentration of the chlorate ions is from about 0.02 to about 0.7 g/l. More preferably, the concentration of the chlorate ions is from about 0.07 to about 0.1 g/l.

The zinc phosphate bath of the present invention can be prepared with the above mentioned ingredients in the concentrations specified above or can be prepared in the form of aqueous concentrates in which the concentration of the various ingredients is considerably higher. Concentrates are generally prepared beforehand and shipped to the application site where they are diluted with aqueous medium such as water or are diluted by feeding them into a zinc phosphate bath which has been in use for some time. For example, a concentrate is typically 5 to 50 (preferably 10 to 20) times more concentrated than the end working bath, and would be diluted accordingly prior to use.

The method of application of the coating to the metal surface (i.e., the step of "contacting" the metal surface with a zinc phosphate bath) can be accomplished by any known coating process, such as dipping, flooding, spraying, intermittent spraying, dipping followed by spraying, spraying followed by dipping, or other combinations thereof. In most cases, the solution is applied by dipping.

During the application process, a number of process conditions can be varied in a known manner in order to achieve a desired coating weight on the metal surface and acceptable coating quality. The desired coating weight of the metal depends on the end use of the metal (including the severity of the deformation process) and the type and size of metal being coated. Preferably, the coating weights are in the range of from about 150 to about 6,000 mg/ft$^2$, more preferably, between about 350 and 4,500 mg/ft$^2$, and, most preferably, between about 400 and 800 mg/ft$^2$.

The process conditions which influence the coating weight include the composition of the zinc phosphate bath, the treating temperature, the contact time, the acidity of the bath, the method of application of the bath, and the particulars of the metal being coated. In general, the coating weight increases with: an increase in concentration of certain constituents of the zinc phosphate bath (e.g., zinc and phosphate); an increase in the treating temperature; and an increase in the contact time. Also, a metal surface which has been sprayed with the zinc phosphate bath may have a greater coating weight than a metal surface which has been dipped, assuming that other conditions are the same.

Some examples of ranges of these conditions are given below. Because of the interrelation of these conditions, however, it should be noted that these ranges are exemplary and a single condition is affected by the other conditions. For example, if a higher treating temperature is used, then the contact time may be reduced in order to achieve the same coating weight for a process using a lower treating temperature and a longer contact time. In sum, the application process conditions should be set in a way such that a coating of a desired weight and of adequate quality (e.g., color, uniformity in coating, crystal size, etc.) is applied to the metal surface.

For example, the application of the zinc phosphate bath can be carried out at a wide range of temperatures. The temperature of the bath may range from about 140° F. to 210° F., although there is no reason to believe that temperatures outside of this range will prevent the composition from having the desirable effects. Generally, a slight change in the temperature win not necessitate substantial alteration of the treating time or concentrations of reactants. Preferably, the application process is carried out at an elevated temperature (i.e., at about 170° F. to 180° F.). In deciding the temperature, the benefit of a higher coating weight or production rate due to an increased temperature must be weighed against the cost of applying heat to the bath.

The time of treatment of a metal surface with the baths of the various steps need only be long enough to ensure complete wetting of the surface and can be as long as thirty minutes. When dipping, the contact time typically ranges from about ten seconds to about five minutes. When spraying, the contact time typically ranges from about ten seconds to about three minutes. In deciding the contact time, the benefit of a higher coating weight due to an increased contact time must be weighed against the cost of the reduced throughput due to the longer contact time.

The resulting coating on the metal surface is continuous and uniform with a crystalline structure. The desired coating is black and smooth, with uniform and complete coverage. The desired coating also adheres tightly to the metal. With such a coating, a relatively higher number of drawings during cold working can be made without damage to the dies or surface imperfections. Also, such a coating leads to improved corrosion resistance and paint adhesion.

During the deposition of a zinc phosphate coating, components of the solution are consumed by the formation of the coating, the formation of sludge, and by the mechanical discharge of phosphatizing solution. The bath must therefore be periodically replenished by adding the depleted components individually or together. A concentrated replenishment bath is preferably used.

Certain other steps may be done both prior to and after the deposition of the zinc phosphate coating. For example, before the metal surfaces are treated with the zinc phosphate bath, they are cleaned in a conventional manner to remove any contaminants which might interfere with the zinc phosphate coating process or subsequent processing. Various methods for cleaning metal surfaces have been used. The particular cleaner selected is important in that it is desirable to have a strong cleaning agent to adequately remove any residual oil or dirt from the metal surface, but it is undesirable to cause over-etching of the metal surface. A typical cleaning bath is an alkaline cleaning bath, which might be an aqueous solution of an alkaline-based cleaner of sodium or potassium hydroxide, optionally containing surfactants, sequestrants, and builders. It should be noted that in some applications, such as in the treatment of drawn wire, the cleaning step consists of removing oxides through the use of an acidic pickling bath.

After the optional cleaning step (and an optional water rinse step following the cleaning step), any scale, smut, or rust which may be present should be removed by a pickling agent, such as sulfuric acid or hydrochloric acid. After another optional water rinse step, the cleaned and pickled metals may then be prerinsed (or conditioned) in a known manner, such as with an activating bath containing titanium phosphate, in order to promote the formation of finely crystalline phosphate coatings. More specifically, it is believed that this conditioning step provides nucleation sites on the metal surface of the metal substrate resulting in the formation of a densely packed crystalline coating which enhances performance.

After the zinc phosphate coating is deposited and especially for prepaint applications, it might be desirable to subject the coating to a post-treatment rinse to seal the coating and improve performance. The rinse composition may contain chromium or may be chromium-free. Such rinses are well known in the art and can incorporate zirconium compounds. Thereafter, the metal surface can optionally then be rinsed with water then dried by any known technique, such as by forced air or flash drying.

Especially for cold forming applications, the coated metal is contacted with a second, conventional cold forming lubricant. This can be done immediately after coating (or rinsing), at press side immediately before cold deformation, or during part of all of the cold working process. The lubricant can be a soap, oil, drawing compound, or an emulsion of an oil and fatty acid, fatty acid salt, or soap. The lubricant may also be borax.

In the case where the composition and method of the present invention are used to pretreat a metal surface before the application of paint, the same considerations discussed above dictate the process conditions. The stages in a pretreatment process are applied to a metal object which has already been fabricated, such as a cold-rolled object. Typically, the order of stages before painting are: (1) cleaning, by use of an alkaline or acid cleaning solution; (2) water rinse; (3) pretreatment; (4) water rinse; then (5) a final rinse with a corrosion resistance enhancing material such as chromate. The composition may also be used as a dried-in-place pretreatment, in which case steps (4) and (5) are eliminated. All other process conditions and steps in pretreating a metal surface are well-known in the art and are described in Assignee's co-pending U.S. patent application Ser. No. 08/774,935, filed on Dec. 20, 1996, entitled METHOD AND COMPOSITION FOR TREATING METAL SURFACES, which is incorporated herein by reference.

EXAMPLES

The following examples are included to more clearly demonstrate the overall nature of the invention. These examples are exemplary, not restrictive, of the invention.

Example 1 (Comparative)

Carbon rod steel, 4037 alloy, was immersed in a 10% sulfuric acid bath to remove rust and scale. After rinsing with water, the wire was then immersed in a phosphatizing bath at 180° F. for 5 minutes. The composition of the bath was:

| COMPONENT | CONCENTRATION (g/l) |
|---|---|
| Zn | 6.0 g/L |
| Ni | 0.07 g/L |
| $NO_3$ | 5.3 g/L |
| $P_2O_5$ | 23.0 g/L |

After rinsing with water and drying, the phosphate coating was observed to be gray and patchy with crystal sizes averaging 120 $\mu$m. The coating weight was 3,300 mg/ft$^2$. The coating was not tightly adherent.

Example 2 (Invention)

Another sample of the same carbon rod steel, 4037 alloy, was cleaned and rinsed in the same manner as in Example 1. In particular, the sample was immersed in a 10% sulfuiric acid bath to remove rust and scale, under the same conditions as Example 1. After rinsing with water, the wire was then immersed in a second phosphatizing bath at 180° F. for 5 minutes. The composition of the second bath was:

| COMPONENT | CONCENTRATION (g/l) |
|---|---|
| Zn | 6.0 g/L |
| Ni | 0.07 g/L |
| $NO_3$ | 5.3 g/L |
| $P_2O_5$ | 23.0 g/L |
| $TiF_6$ | 0.01 g/L |
| FLUORAD FC-99 | 0.01 g/L |
| FLUORAD FC-170C | 0.01 g/L |

After rinsing with water and drying in the same manner as in Example 1, the phosphate coating was observed to be black, smooth, with complete coverage. Crystal sizes averaged 10–15 $\mu$m. The coating weight was 1,900 mg/ft$^2$. The coating was very adherent.

Example 3 (Comparative)

Steel wire, 1010 alloy, was immersed in a 12% hydrochloric acid bath to remove rust and scale. After rinsing with water, the wire was then immersed in a phosphatizing bath at 170° F. for 5 minutes. The composition of the bath was:

| COMPONENT | CONCENTRATION (g/l) |
|---|---|
| Zn | 12.5 g/L |
| Ni | 0.15 g/L |
| $NO_3$ | 17.5 g/L |
| $P_2O_5$ | 31.0 g/L |

After rinsing with water and drying, the phosphate coating was observed to be dark gray and uniform with a coating weight of 710 mg/ft$^2$.

Example 4 (Invention)

Another sample of the same steel wire, 1010 alloy, was cleaned and rinsed in the same manner as in Example 3. In particular, the sample was immersed in a 12% hydrochloric acid bath to remove rust and scale, under the same conditions as Example 1. After rinsing with water, the wire was then immersed in a fourth phosphatizing bath at 170° F. for only 3 minutes. The composition of the fourth bath was:

| COMPONENT | CONCENTRATION (g/l) |
|---|---|
| Zn | 12.5 g/L |
| Ni | 0.15 g/L |
| $NO_3$ | 17.5 g/L |
| $P_2O_5$ | 31.0 g/L |
| $TiF_6$ | 0.01 g/L |
| FLUORAD ® FC-99 | 0.01 g/L |
| FLUORAD ® FC-170C | 0.01 g/L |

After rinsing and drying in the same manner as in Example 3, the phosphate coating was observed to be extremely dark gray/almost black, with complete coverage. The coating weight was 870 mg/ft$^2$.

The above examples reveal that samples treated by a bath of the present invention have better performance over others in terms of coverage (as judged by appearance such as color and uniformity) and the desired coating weight.

Comparing Examples 1 and 2, a revealing quality was that the coating of comparative Example 1 was not tightly adherent while that of Example 2 was very adherent. Accordingly, if the two samples were subsequently cold worked, the coating of Example 1 would more easily be separated from the metal surface, thereby causing the lubricant to become disassociated with the metal surface. The fact that the sample of Example 1 had a patchy coating while that of Example 2 was uniform is also important. The areas where the coating was not covering the metal surface in Example 1 would be areas where a lubricant would not likely be retained on the metal surface. The crystal size is also evidence of the improved quality of the coating of Example 2. The significantly smaller crystals of Example 2 lead to an improved coating. In Examples 1 and 2, the coating weights are not too important of a factor because both of them are sufficiently high to provide a good lubricant carrier function, as long as the quality and uniformity of the coating is sufficient.

In the case of Examples 3 and 4, the coating weight is an important factor because it is relatively low. In this application, it was deemed important to achieve a coating weight of at least 800 mg/ft$^2$. This coating was achieved by a bath of the present invention while it was not achieved by the comparative bath. More impressively, the higher coating weight was achieved in a shorter time (three minutes versus five minutes), which would significantly improve efficiency.

Although illustrated and described herein with reference to certain specific embodiments and examples, the present invention is nevertheless not intended to be limited to the details shown. Rather, the claims should be read to include various modifications within the scope and range of equivalents of the claims, without departing from the spirit of the invention.

What is claimed is:

1. A method for forming a zinc phosphate coating on a metal surface comprising contacting the metal surface with a bath comprising an aqueous solution of zinc, phosphate, nitrate, nickel, a compound containing a group IV-B element, and a fluosurfactant.

2. The method in accordance with claim 1 further comprising chlorate ions.

3. The method in accordance with claim 1, wherein the concentration of said chlorate ions is from about 0.02 to about 0.7 g/l.

4. The method in accordance with claim 1, wherein:

the concentration of zinc is from about 1 to about 30 g/l;

the concentration of phosphate (measured as $P_2O_5$) is from about 2 to about 60 g/l;

the concentration of nitrate is from about 1 to about 35 g/l;

the concentration of nickel is from about 0.002 to about 0.4 g/l;

the concentration of said compound containing a group IV-B element (measured as the group IV-B element) is from about 0.001 to about 0.1 g/l; and the concentration of said fluosurfactant is from about 0.0001 to about 0.1 g/l.

5. The method in accordance with claim 4, wherein:

the concentration of zinc is from about 5 to about 15 g/l;

the concentration of phosphate (measured as $P_2O_5$) is from about 20 to about 40 g/l;

the concentration of nitrate is from about 5 to about 20 g/l;

the concentration of nickel is from about 0.05 to about 0.2 g/l;

the concentration of said compound containing a group IV-B element (measured as the group IV-B element) is from about 0.004 to about 0.007 g/l; and the concentration of said fluosurfactant is from about 0.005 to about 0.02 g/l.

6. The method in accordance with claim 1, wherein said compound containing a group IV-B element is selected from the group consisting of a fluoacid of at least one of titanium, zirconium, and hafnium.

7. The method in accordance with claim 6, wherein said fluoacid is fluotitanic acid.

8. The method in accordance with claim 1, wherein said fluosurfactant is a fluorocarbon selected from the group consisting of an amine perifluoroalkyl sulfonate and a non-ionic, fluorinated alkyl polyoxethylene ethanol.

9. A composition for forming a zinc phosphate coating on a metal surface comprising a bath comprising an aqueous solution of zinc, phosphate, nitrate, nickel, a compound containing a group IV-B element, and a fluosurfactant.

10. The composition in accordance with claim 9 further comprising chlorate ions.

11. The composition in accordance with claim 10, wherein the concentration of said chlorate ions is from about 0.02 to about 0.7 g/l.

12. The composition in accordance with claim 9, wherein:

the concentration of zinc is from about 1 to about 30 g/l;

the concentration of phosphate (measured as $P_2O_5$) is from about 2 to about 60 g/l;

the concentration of nitrate is from about 1 to about 35 g/l;

the concentration of nickel is from about 0.002 to about 0.4 g/l;

the concentration of said compound containing a group IV-B element (measured as the group IV-B element) is from about 0.001 to about 0.1 g/l; and the concentration of said fluosurfactant is from about 0.0001 to about 0.1 g/l.

13. The composition in accordance with claim 12, wherein:

the concentration of zinc is from about 5 to about 15 g/l;

the concentration of phosphate (measured at $P_2O_5$) is from about 20 to about 40 g/l;

the concentration of nitrate is from about 5 to about 20 g/l;

the concentration of nickel is from about 0.05 to about 0.2 g/l;

the concentration of said compound containing a group IV-B element (measured as the group IV-B element) is from about 0.004 to about 0.007 g/l; and the concentration of said fluosurfactant is from about 0.005 to about 0.02 g/l.

14. The composition in accordance with claim 9, wherein said compound containing a group IV-B element is selected from the group consisting of a fluoacid of at least one of titanium, zirconium, and hafnium.

15. The composition in accordance with claim 14, wherein said fluoacid is fluotitanic acid.

16. The composition in accordance with claim 9, wherein said fluosurfactant is a fluorocarbon selected from the group consisting of an amine perfluoroalkyl sulfonate and a non-ionic, fluorinated alkyl polyoxethylene ethanol.

17. A composition for forming a zinc phosphate coating on a metal surface comprising a bath comprising an aqueous solution of from about 1 to about 30 g/l zinc, from about 2 to about 60 g/l phosphate (measured as $P_2O_5$), from about 1 to about 35 g/l nitrate, from about 0.002 to about 0.4 g/l nickel, from about 0.001 to about 0.1 g/l of a fluoacid of at least one of titanium, zirconium, and hafnium (measured as at least one of titanium, zirconium, and hafnium), and from about 0.0001 to about 0.1 g/l of a fluosurfactant.

18. The composition in accordance with claim 17 further comprising chlorate ions.

19. The composition in accordance with claim 18, wherein the concentration of said chlorate ions is from about 0.02 to about 0.7 g/l.

20. The composition in accordance with claim 17, wherein said fluosurfactant is a fluorocarbon selected from the group consisting of an amine perfluoroalkyl sulfonate and a non-ionic, fluorinated alkyl polyoxethylene ethanol.

* * * * *